US008693920B2

(12) United States Patent
Birumachi

(10) Patent No.: US 8,693,920 B2
(45) Date of Patent: Apr. 8, 2014

(54) IMAGE FORMING APPARATUS THAT PERFORMS IMAGE FORMATION USING DIFFERENT TYPES OF DRIVING FORCES IN COMBINATION

(75) Inventor: Takashi Birumachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 13/175,363

(22) Filed: Jul. 1, 2011

(65) Prior Publication Data

US 2012/0003010 A1 Jan. 5, 2012

(30) Foreign Application Priority Data

Jul. 2, 2010 (JP) ..... 2010-151990

(51) Int. Cl.
*G03G 15/00* (2006.01)

(52) U.S. Cl.
USPC ..... 399/167

(58) Field of Classification Search
USPC ..... 399/167
See application file for complete search history.

(56) References Cited

U.S. PATENT DOCUMENTS

| | | | | |
|---|---|---|---|---|
| 2005/0084293 | A1* | 4/2005 | Fukuchi et al. | 399/167 |
| 2007/0242980 | A1 | 10/2007 | Kikuchi et al. | |
| 2007/0253735 | A1 | 11/2007 | Sato | |
| 2009/0285601 | A1 | 11/2009 | Akamatsu | |
| 2011/0268475 | A1 | 11/2011 | Birumachi | |

FOREIGN PATENT DOCUMENTS

| | | | |
|---|---|---|---|
| CN | 101063840 | A | 10/2007 |
| JP | 10-186952 | A | 7/1998 |
| JP | 2003-091128 | A | 3/2003 |
| JP | 2007-047629 | A | 2/2007 |
| JP | 2009-258424 | A | 11/2009 |

OTHER PUBLICATIONS

Office Action issued in Japanese Patent Application 2010-151990 dated Dec. 24, 2013.
CN OA Jul. 25, 2013 for corres. CN 201110185167.6 (English translation provided).

* cited by examiner

*Primary Examiner* — Ryan Walsh
(74) *Attorney, Agent, or Firm* — Rossi, Kimms & McDowell LLP

(57) ABSTRACT

An image forming apparatus capable of achieving improved image quality even when image formation is performed using a plurality of types of drive sources different in characteristics. Image forming units for colors form toner images of the respective colors on respective photosensitive drums each of which is driven by a DC motor for rotation. Encoder sensors detect information on the rotational speed of the photosensitive drums. An image forming unit for black forms a black toner image on a photosensitive drum having an outer diameter larger than that of the photosensitive drums for colors, which is driven by a stepper motor for rotation. An intermediate transfer belt transfers toner images formed on the respective photosensitive drums to a sheet. A motor controller controls a drive frequency of the stepper motor based on information on the rotational speed of the photosensitive drum for black.

6 Claims, 7 Drawing Sheets

IMAGE FORMING APPARATUS THAT PERFORMS IMAGE FORMATION USING DIFFERENT TYPES OF DRIVING FORCES IN COMBINATION

BACKGROUND OF THE INVENTION

1. Field of the Invention

The present invention relates to an image forming apparatus using an electrophotographic method, such as a copy machine, a printer, a facsimile machine, and a multifunction peripheral integrating the functions of these apparatuses.

2. Description of the Related Art

In a color image forming apparatus using an electrostatic method, image formation is performed by the well-known electrophotographic process in which toner (developer) images are formed on surfaces of photosensitive drums for respective colors, and the toner images of the respective colors on the photosensitive drums are transferred to a recording sheet via an endless belt-like intermediate transfer member. Drive sources for driving the plurality of photosensitive drums for rotation are generally implemented by a single kind of motors (e.g. brushless DC motors or stepper motors). Particularly, a brushless DC motor as an outer rotor-type motor is often employed from the viewpoint of rotational stability. The reason for this is as follows:

(1) Compared with an inner rotor-type motor, the moment of inertia of the rotor itself can be increased, and rotation fluctuations caused by the motor are less liable to be transmitted to the load side (photosensitive drum) when the rotational speed is not lower than a predetermined rotational speed.

(2) Even when load fluctuation is generated, the load fluctuation is suppressed by an amount corresponding to a gear reduction ratio by a speed reducer, and at the same time, the rotation fluctuation can be suppressed by the flywheel effect of the rotor.

(3) By controlling the motor drive by a PLL control method, it is possible to improve the rotational stability.

As mentioned above, the outer rotor-type brushless DC motor has above advantages (1) to (3), but on the other hand, a start-up time and a stop time of the motor sometimes vary depending on load torque. Particularly, in an image forming apparatus which drives a plurality of photosensitive drums by respective separate brushless DC motors, this problem brings about a fluctuation in rotational phase between the respective photosensitive drums.

As a countermeasure to differences in rotational phase between the respective photosensitive drums, there has been proposed e.g. a method in which a toner patch as a reference is formed on each of the photosensitive drums, and an optical sensor reads a result of transfer of the toner patches on the respective photosensitive drums to the intermediate transfer belt, thereby correcting the differences in rotational phase. There is also proposed a method of performing feedback control using a rotational speed-detecting unit provided on each photosensitive drum shaft, to thereby stabilize the rotational speed of the photosensitive drums. This method, however, employs not the PLL control method which requires rotational stability of a motor output shaft but a control method which is capable of variably controlling the motor rotational speed.

As described above, there have been proposed various kinds of methods for the electrophotographic image forming apparatus with a view to improving image quality. However, all the methods are effective only when the photosensitive drums of the respective colors have the same diameter.

In recent years, for the purpose of improving productivity and the like, there has been proposed an image forming apparatus that employs different diameters for a photosensitive drum for black and photosensitive drums for the other colors. In such an image forming apparatus, if driving sources of the respective photosensitive drums are implemented by motors of the same type, this requires a reduction gear ratio of each speed reducer (e.g. the number of reduction gears) to be changed. As a result, the ranges of rotational speeds toward the motor side become largely different, which sometimes makes the influence of motor-side rotational fluctuation on the load side (photosensitive drums) conspicuous, or causes rotation fluctuation due to load fluctuation. To improve such a situation, there has been proposed a technique that improves image quality by using motors of a plurality of types instead of the motors of the same type (see e.g. Japanese Patent Laid-Open Publication No. 2007-47629).

In an electrostatic color image forming apparatus disclosed in Japanese Patent Laid-Open Publication No. 2007-47629, when the same color stability of a color image as reproduced by an offset printing machine is required, it is necessary to always keep the same phase relationship between the photosensitive drums. As a result, to make the photosensitive drums in phase with each other, the photosensitive drum for black is driven by an outer rotor-type motor, and the photosensitive drums for the other colors are driven by an inner rotor-type motor, whereby the motors of different types are mixedly used.

Further, Japanese Patent Laid-Open Publication No. 2007-47629 describes that a brushless DC motor as an outer rotor-type motor has the advantage of contributing to stabilization of rotational speed, but has the disadvantage of a rotational angle at the start of rotation or at the stop of rotation being liable to vary depending on the load torque. As a result, Japanese Patent Laid-Open Publication No. 2007-47629 proposes employing an arrangement in which the photosensitive drums other than the photosensitive drum for black are each driven by a stepper motor as an inner rotor-type motor, thereby preventing color misregistration by phasing and facilitating the color misregistration prevention.

In the case of the arrangement in which a plurality of photosensitive drums and an intermediate transfer member are separately driven, if the brushless DC motors as outer rotor-type motors are employed, the brushless DC motor has the above-mentioned disadvantage of a rotational angle at the start of rotation or at the stop of rotation being liable to vary depending on the load torque. That is, if the level of load is different between the respective drive sources, there is caused a difference in the change of the rotational speed when starting or decelerating the motors, which generates a difference in speed between the photosensitive drums and the intermediate transfer member, and as a result, this causes scratches on the surfaces of the photosensitive drums and also causes image deterioration. To solve such a problem, there has been proposed an improving method employing speed profile definitions at the start and stop of motors, gain adjustment, and braking control (see e.g. Japanese Patent Laid-Open Publication No. 2003-091128).

In Japanese Patent Laid-Open Publication No. 2003-091128, the stepper motors are each subjected to speed control using the same start and stop profile, and the brushless DC motor is subjected to current control such that a speed change equivalent to that in each stepper motor is caused, by performing position and speed detection using an encoder.

As described in Japanese Patent Laid-Open Publication No. 2007-47629, when the stepper motor and the brushless DC motor are used in combination as the drive sources for the plurality of photosensitive drums and the intermediate transfer member, this brings about the following two problems:

(1) Occurrence of a displacement of a rotor due to a change in torque of the stepper motor As shown in FIGS. 6A and 6B, when constant current control which is generally employed in the method of driving a stepper motor is performed, as a unique characteristic of the stepper motor, the position of the rotor of the motor changes depending on the load torque. That is, although speed of the stepper motor is controlled according to the frequency of an input speed command signal (pulse signal), if a change is caused in the load torque, displacement in the rotor and speed fluctuation caused by the displacement are caused, and as a result, color misregistration in a generated image is caused. Particularly, when the stepper motor is employed for the drive source for the photosensitive drum for black, the reduction ratio is not large (i.e. influence of the displacement on the motor shaft side does not become small), and at the same time the outer diameter of the photosensitive drum is larger than that of the other photosensitive drums. Therefore, this causes a problem that displacement in the angle through which the motor shaft rotates is likely to affect the displacement of the surface of the photosensitive drum.

To prevent such displacement of the position of the rotor due to a change in the load torque, it is necessary to increase the exciting current supplied to the stepper motor. However, this causes an increase in power consumption and a rise in the temperature of the motor.

(2) Generation of a difference in speed between the stepper motor and the brushless DC motor at the start-up time, and an increase in the difference in peripheral speed between the photosensitive drums and the intermediate transfer member and an increase in torque, which are caused by the difference in the speed between the motors.

Although the brushless DC motor is subjected to current control by a feedback control method for speed control such that as the difference in actual rotational speed from the set speed is larger, acceleration is increased, the acceleration is not always constant due to the load torque. For this reason, in general, a large difference in the acceleration may be generated between the brushless DC motor and the stepper motors subjected to an open-loop speed control. As a result, the peripheral speed difference from the intermediate transfer belt causes a large change in the load applied to each stepper motor, which causes a problem that the stepper motor suffers from a loss of synchronism at the start-up time. Further, also on the brushless DC motor side, a torque increase caused by a reaction force brings about an increase in supply current or an increase in the start-up time.

Japanese Patent Laid-Open Publication No. 2003-091128 proposes a technique for preventing a speed difference between the motors of the same type (e.g. between only the brushless DC motors or between only the stepper motors). However, the document discloses no discussion about a method of reducing a difference in drive characteristics between different types of motors.

SUMMARY OF THE INVENTION

The present invention provides an image forming apparatus which is capable of achieving improved image quality even when image formation is performed using a plurality of types of drive sources having different characteristics in combination.

In a first aspect of the present invention, there is provided an image forming apparatus comprising a first image forming unit configured to form a toner image on a first photosensitive drum, a DC motor configured to drive the first photosensitive drum for rotation, a detection unit configured to detect information on a rotational speed of the first photosensitive drum, a second image forming unit configured to form a toner image on a second photosensitive drum having an outer diameter larger than that of the first photosensitive drum, a stepper motor configured to drive the second photosensitive drum for rotation, a transfer unit configured to transfer toner images formed on the first and second photosensitive drums to a sheet, and a control unit configured to control a drive frequency of the stepper motor based on information on the rotational speed of the first photosensitive drum.

In a second aspect of the present invention, there is provided an image forming apparatus comprising an image forming unit configured to form a toner image on a photosensitive drum, a stepper motor configured to drive the photosensitive drum for rotation, a transfer unit configured to transfer a toner image formed on the photosensitive drums to a sheet, a DC motor configured to drive the transfer unit, a detection unit configured to detect information on a rotational speed of the DC motor, and a control unit configured to control a drive frequency of the stepper motor based on information on the rotational speed of the DC motor.

According to the present invention, when a plurality of types of drive sources having different characteristics are used in combination, and it is possible to synchronize speeds by using control information on each other, and reduce power consumption and improve image quality by controlling current (torque).

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
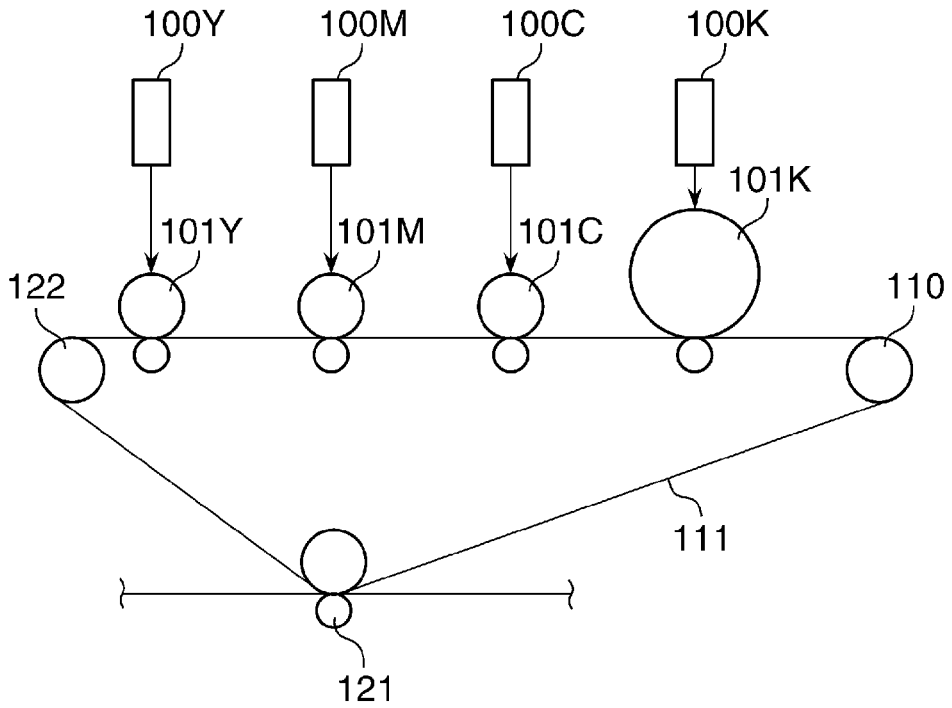
FIG. 1 is a schematic diagram of image forming units in an image forming apparatus according to an embodiment.

FIG. 1 is a schematic diagram of image forming units of an image forming apparatus according to an embodiment.

Referring to FIG. 1, the image forming apparatus is a color image forming apparatus including image forming units for four colors of yellow (Y), magenta (M), cyan (C), and black (B). The image forming units have a plurality of photosensitive drums 101Y, 101M, 101C, and 101K for forming electrostatic latent images of the respective colors of YMCK, and laser scanners 100Y, 100M, 100C, and 100K for forming electrostatic latent images on the respective photosensitive drums.

An intermediate transfer belt 111 is an endless belt-like intermediate transfer member onto which toner images formed on the respective photosensitive drums 101 are sequentially transferred in a superimposed manner. An intermediate transfer belt drive roller 110 supports one end of the intermediate transfer belt 111, and is used for driving the intermediate transfer belt 111 for rotation. A roller 122 supports the other end of the intermediate transfer belt 111. A secondary transfer roller 121 is used for collectively transferring the toner images formed on the intermediate transfer belt 111 to a recording sheet.

Note that although around each photosensitive drum 101, there are arranged a primary electrostatic charger, a developing device, a transfer charger, a pre-exposure lump, a cleaner, and so forth, they are omitted from illustration of the example.

Figure 2:
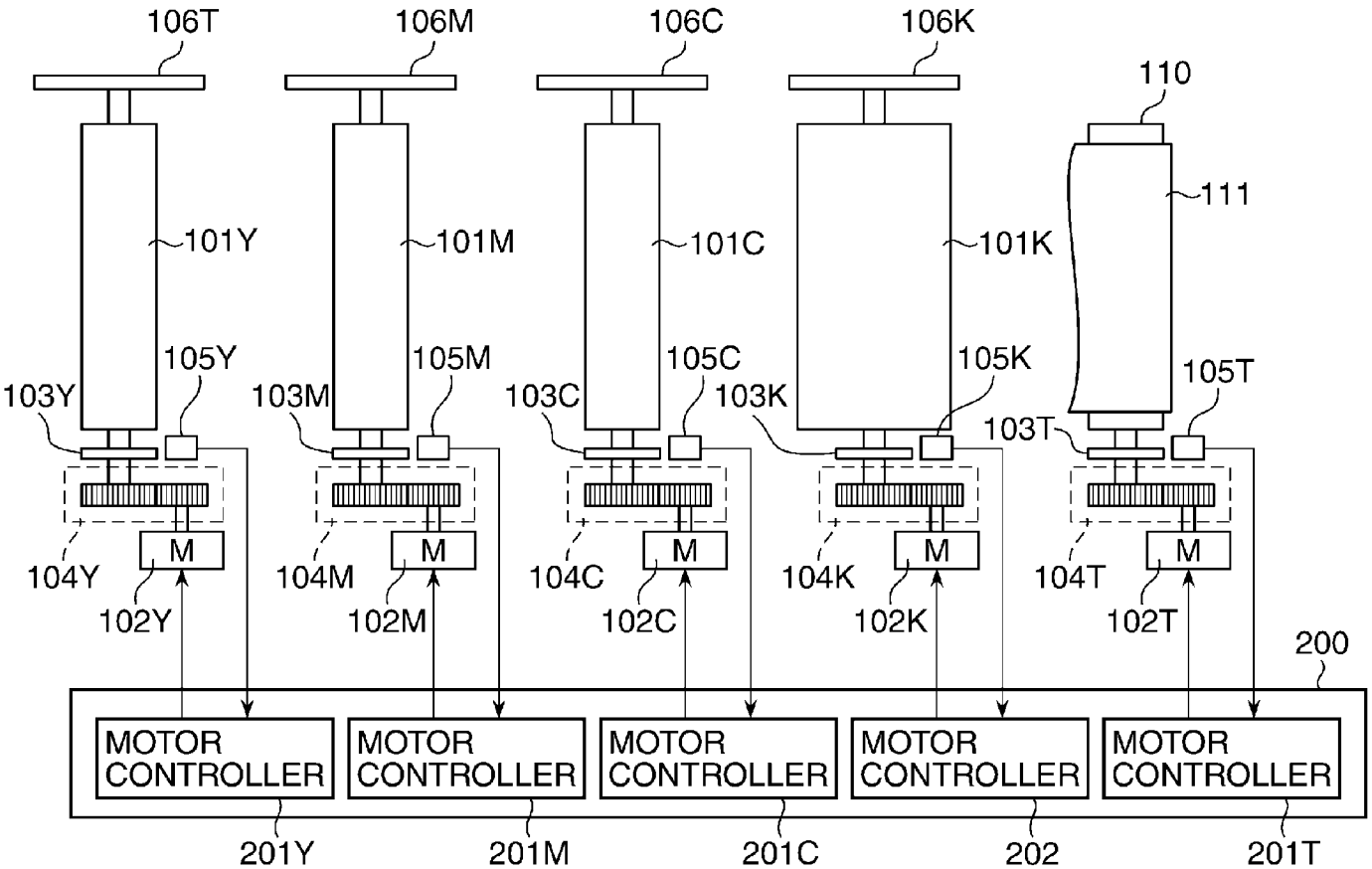
FIG. 2 is a schematic diagram of drive units for photosensitive drums and an intermediate transfer belt appearing in FIG. 1 and a control unit for controlling the drive units.

FIG. 2 is a schematic diagram of drive units of the photosensitive drums 101Y, 101M, 101C, and 101K and the intermediate transfer belt 111 appearing in FIG. 1, and a control unit for controlling the drive units.

In FIG. 2, drive motors 102Y, 102M, 102C, and 102K are motors independently provided for driving the photosensitive drums 101Y, 101M, 101C, and 101K, respectively. Speed reducers 104Y, 104M, 104C, and 104K are speed reducing mechanisms for connecting the drive motors 102Y, 102M, 102C, and 102K to the photosensitive drums 101Y, 101M, 101C, and 101K, respectively, and converting a rotational speed of each drive motor to a predetermined rotational speed by speed reduction.

A drive motor 102T is used for driving the intermediate transfer belt drive roller 110. A speed reducer 104T is a speed reducing mechanism for connecting the drive motor 102T to the intermediate transfer belt drive roller 110, and converting a rotational speed of the drive motor 102T to a predetermined rotational speed by speed reduction.

Although in the present embodiment, the speed reducers 104Y, 104M, 104C, 104K, and 104T are each formed by a combination of helical gears, this is not limitative, but the speed reducers may be formed by any of other suitable gears, a belt, etc.

Encoder wheels 103Y, 103M, 103C, 103K, and 103T are disks each having slits arranged in a circumferential direction at equally-spaced intervals. These encoder wheels 103Y, 103M, 103C, 103K, and 103T are provided on respective drive shafts of the photosensitive drums 101Y, 101M, 101C, and 101K, and the intermediate transfer belt drive roller 110, each for detecting an angular speed of the associated drive shaft. Encoder sensors 105Y, 105M, 105C, 105K, and 105T are optical sensors which optically detect the slits provided in the encoder wheels 103. The encoder sensor 105T is a speed-detecting unit (third speed-detecting unit) for detecting a shaft speed of the intermediate transfer belt drive roller 110 which drives the intermediate transfer belt 111 as the intermediate transfer member for rotation.

Flywheels 106Y, 106M, 106C, and 106K are each used for reducing fluctuation of the rotational speed of an associated one of the photosensitive drums 101Y, 101M, 101C, and 101K.

The photosensitive drum for black (hereinafter referred to as the "black drum") 101K (first image bearing member) has an outer diameter larger than that of the photosensitive drums for the other colors than black (hereinafter referred to as the "color drums"), which is set to e.g. ϕ84.

On the other hand, the color drums 101Y, 101M, and 101C (second image bearing members) each have the outer diameter, which is set to e.g. ϕ30.

The reason for setting the outer diameter of the black drum to be larger than that of the color drums, as mentioned above, is that monochrome printing is generally more often used than color printing and hence the circumferential length of the black drum is increased to thereby prolong the service life of the photosensitive drum.

For both of the speed reducer 104K for the black drum and the speed reducers 104Y, 104M, and 104C for the color drums, there are used the speed reducers of the same model. The reason for using the speed reducers of the same model is to make the repetition period of generation of rotation fluctuation caused by a gear error identical between the drums, by using the same reduction ratio and the same members.

The drive motors 102Y, 102M, and 102C (second drive sources) for the color drums are brushless DC motors, which are outer rotor-type motors, and the drive motor 102K (first drive source) for the black drum is a stepper motor, which is an inner rotor-type motor. Further, the drive motor 102T (third drive source) for driving the intermediate transfer belt 111 as the intermediate transfer member is a brushless DC motor which is an outer rotor-type motor.

To cause the respective peripheral speeds of the black drum and the color drums to match the peripheral speed of the intermediate transfer belt 111 at a contact surface of the intermediate transfer belt 111, the ratio between a speed set to the drive motor 102K for the black drum and a speed set to the drive motors 102Y, 102M, and 102C for the color drums is made equal to a ratio between the drum diameters (30/84). For example, when the target rotational speed of the brushless DC motor is set to 1807 rpm, the target rotational speed of the stepper motors is set to 645 rpm.

The brushless DC motor normally has 8 to 12 rotor magnetic poles. The brushless DC motor cannot compensate for variation in torque caused by rotational magnetic flux generated by a coil, by the flywheel effect of the moment of inertia of the outer rotor itself, when it is rotating at a low speed, and hence it is not possible to obtain rotational stability. The rotational energy caused by the moment of inertia is generated according to the square of the speed, and hence to compensate for the lowering of the speed by increasing the moment of inertia, a very large rotor is required. That is, the brushless DC motor cannot ensure rotational stability unless the rotational speed thereof is equal to or higher than that a predetermined high rotational speed range determined by the rotor size and the number of magnetic poles. For this reason, to realize stable rotation in a low rotational speed range, it is necessary to increase the rotor size, increase the number of magnetic poles, or increase the number of slots, which may increase the costs.

Although in the stepper motor called hybrid type motor, normally, the number of magnetic poles on the rotor side is only two formed by an N pole and an S pole, by displacing rotor teeth formed of a magnetic steel plate by ½ of a tooth pitch between the N pole and S pole sides, the apparent number of poles is determined by the number of rotor teeth.

This causes the rotor to be driven in a stepped manner in synchronism with switching of the magnetic flux on the coil side, and the rotor to operate in a manner following the magnetic flux on the coil side also in the low speed rotation range. Thus, the stepper motor has a feature that is capable of performing drive control even in the low speed rotation range of several rpm. Further, the stepper motor has a feature that the rotational speed thereof is controlled according to the frequency of an input pulse signal, and output torque can be varied by adjusting the exciting current value.

On the other hand, in the stepper motor, as described above, the rotor is driven in a stepped manner, and hence this causes rotation fluctuation and vibration. Further, the power efficiency of the stepper motor is ½ to ⅓ or less of that of the brushless DC motor, which results in a large loss of energy.

In the image forming apparatus according to the present embodiment, the black drum 101K is configured to have the outer diameter larger than that of the color drums 101Y, 101M, and 101C. With this configuration, the moment of inertia associated with the motor shaft of the black drum is larger than that of the photosensitive drums for colors, each having a smaller outer shape. Therefore, when the photosensitive drum for black is driven by the stepper motor, the vibration transmission associated with the rotation fluctuation caused by the driving using the stepper motor is reduced by the low-pass filter effect by the moment of inertia and frictional resistance. In contrast, if the stepper motor is applied to the drive source for the color drums, energy loss simply becomes three times, and the flywheel effect is also small. For these reasons described above, the brushless DC motors are used as the drive sources for the color drums. On the other hand, by weighing electric efficiency and rotational stability for comparison, to eliminate factors affecting image quality, which are generated by the speed reducer, the stepper motor capable of driving the drum at a low speed is used for the drive source for the black drum.

In FIG. 2, a control unit 200 includes motor controllers 201Y, 201M, 201C, and 202 for controlling the drive motors 102Y, 102M, 102C, and 102K, respectively, and a motor controller 202 for controlling the drive motor 102T. The drive motors 102Y, 102M, 102C, and 102T are controlled by the motor controllers 201Y, 201M, 201C, and 202 based on pulse signals detected by the respective encoder sensors such that they each rotate at a predetermined rotational speed. Note that although in the present embodiment, the angular speed detection is performed by a general rotary encoder using an encoder wheel and an optical sensor, this is not limitative, but any other device (tachogenerator, resolver, etc.) may be used insofar as it can detect rotational speed of a rotating member.

Next, a description will be given of speed control for the drive motor 102K and the drive motors 102Y, 102M, and 102C as the different types of motors with reference to FIGS. 3 to 5. The well-known PID control is employed for the speed control in the present embodiment, and hence only a circuit configuration will be described.

Figure 3:
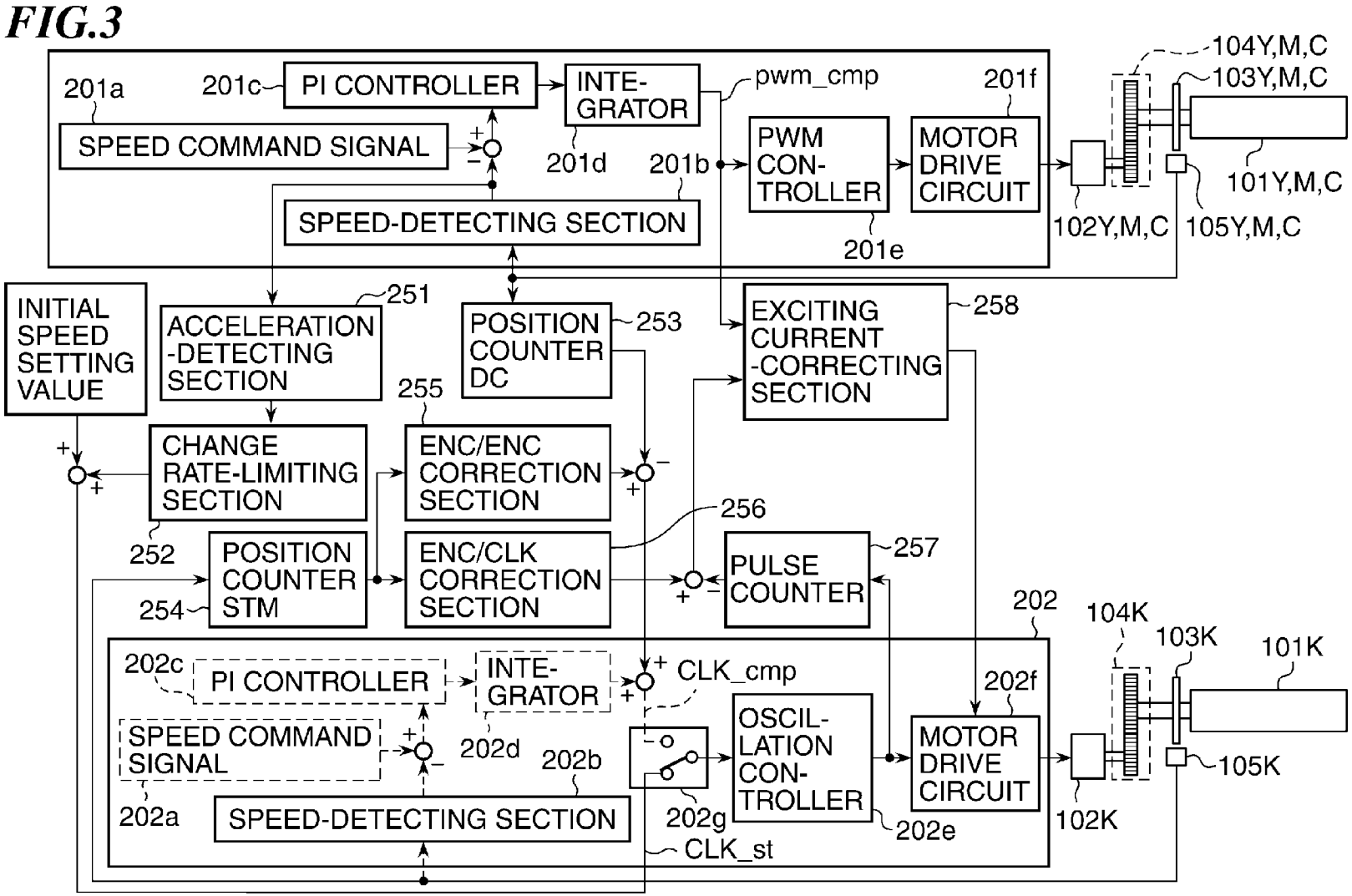
FIG. 3 is a schematic diagram useful in explaining control blocks forming a motor controller appearing in FIG. 2.

FIG. 3 is a schematic diagram useful in explaining control blocks forming the motor controllers 201Y, 201M, 201C, and 202 appearing in FIG. 2. Detailed circuit configuration of the control block within the motor controller 202 appearing in FIG. 3 is illustrated in FIG. 4B.

Figure 5:
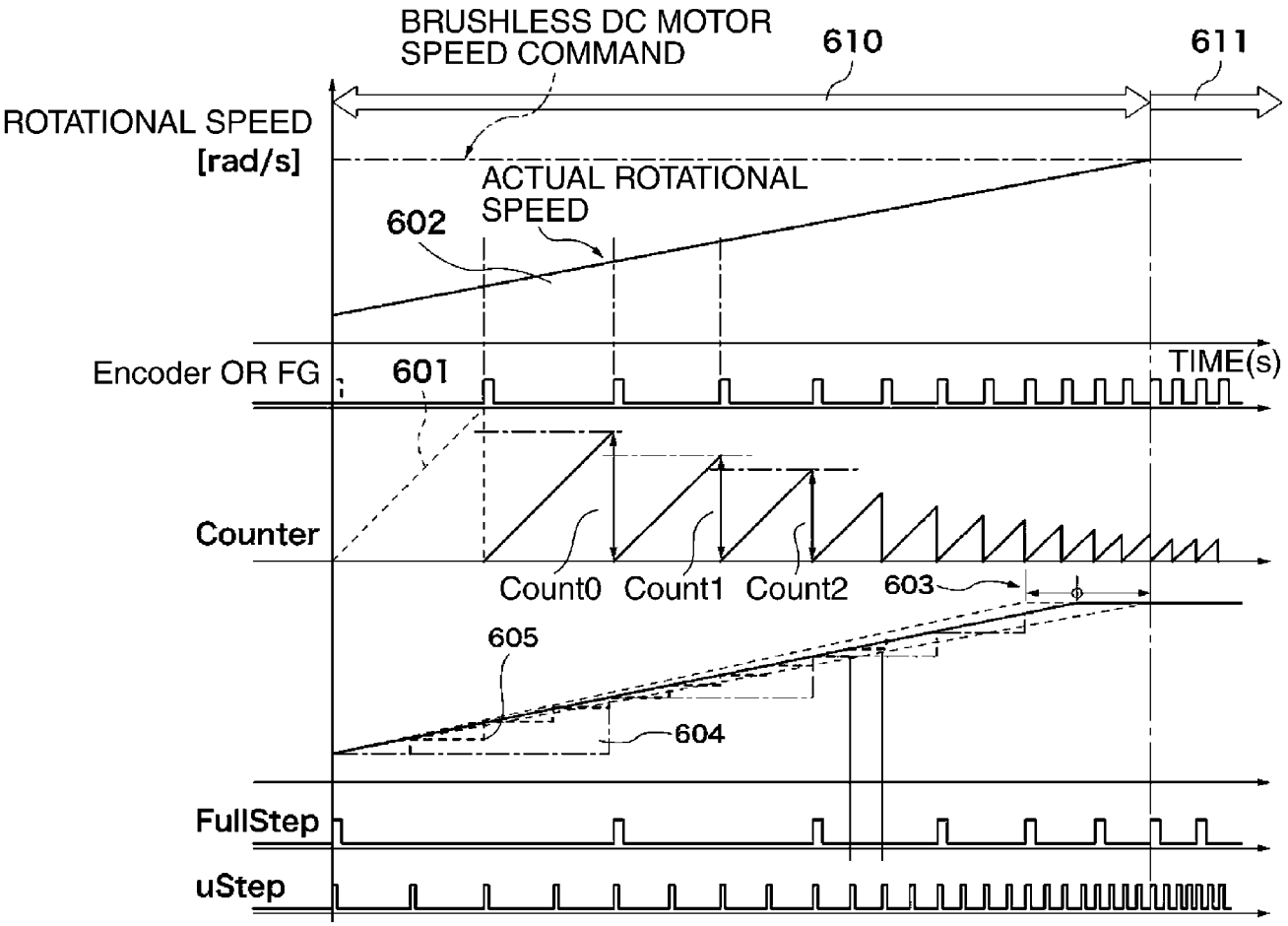
FIG. 5 is a diagram useful in explaining operations of a stepper motor and a brushless DC motor when the speed of the stepper motor is caused to follow up changes in the speed of the brushless DC motor at the start-up of the motors.

In the present embodiment, speed control is performed by causing a control switching unit 202*g* appearing in FIG. 3 to switch the control circuit configuration between when the drive motor is in a start-up region 610 appearing in FIG. 5 and when the drive motor is a constant region 611 appearing in FIG. 5.

First, a description will be given of a method of controlling constant speed of the drum shafts of the color drums 101Y, 101M, and 101C driven by the brushless DC motors when in the constant region 611.

In FIG. 3, the motor controllers 201Y, 201M, 201C (second control units) are control blocks which control the speeds of the brushless DC motors implementing the drive motors 102Y, 102M, and 102C which drive the color drums 101Y, 101M, and 101C, respectively.

The speed control for a brushless DC motor is performed by varying the voltage applied thereto to adjust the amount of a current flowing through the coil and thereby controlling the amount of magnetic flux generated in the coil. Therefore, in general, the speed control is performed by pulse width modulation control (hereinafter referred to as the "PWM control") in which the voltage of a direct current voltage source is controlled by a time period ratio between on and off times switched by a switching unit. In the present embodiment as well, the motor controller 201Y, 201M, and 201C perform the speed control of the drive motors 102Y, 102M, and 102C by the PWM control according to a procedure described hereinbelow.

(a-1) Signals output from the encoder sensors 105Y, 105M, and 105C (second speed-detecting units) are input to a speed-detecting section 201*b*. The speed-detecting section 201*b* is configured to detect respective speeds from the periods of pulse signals from respective pulse signal sequences from the encoder sensors 105Y, 105M, and 105C, or detect respective speeds from respective counts of the pulse signals of respective pulse signal sequences at a predetermined sampling time period (differentiation of a position=speed).

(a-2) Computation for comparison with a speed command signal 201*a* sent from a control unit (not shown) which controls the overall operations of the image forming apparatus is carried out, and the computation result is input to a general PI (proportional integral) controller 201*c*, so as to execute error amplification based on a preset proportional gain and a preset integral gain. Note that the speed command signal 201*a* is a frequency value determined by the resolution of the encoder sensors 105Y, 105M, and 105C, or a count value at a predetermined sampling period.

(a-3) The result of (a-2) is further integrated by an integrator 201*d* whereby a positional deviation (time integration of speed=position) is taken into account.

(a-4) The value of (a-3) is input to a PWM controller 201*e* to generate a PWM signal.

(a-5) A motor drive circuit 201*f* which varies voltage applied to the motors control the rotational speeds of the drive motors 102Y, 102M, and 102C based on the PWM signal generated in (a-4).

The PI controller 201*c* is configured to output, based on the subtraction result of the speed deviation in the preceding stage, a value obtained by adding a proportional term (201*c*-1) multiplied by a proportional gain Kp to an integral term, multiplied by an integral gain Ki (201*c*-3), of a deviation obtained by a one sample delay element (1/z) (201*c*-2).

The integrator 201*d* performs an operation similar to that for calculation of the integral term of the PI controller 201*c*, and is configured to integrate an integral term output from the PI controller 201*c* again. Note that these circuits perform computation processing based on the speed detection signals from the speed-detecting section 201*b* read at a predetermined sampling period.

The PWM controller 201*e* once causes latches the speed detection signals detected at the predetermined sampling period, i.e. speed manipulation values subjected to error amplification, in a latch circuit 201*e*-1 and the values are used as period data in a comparator 201*e*-4, for comparison with a count value counted at a PWM counter 201*e*-3. When the count value becomes equal to a preset value, a comparison output is set to high. Similarly, a shift circuit 201*e*-2 sets ½ of the period data in a comparator 202*e*-5 as pulse width data. When the count values become equal to a preset value, a pulse width period is determined by setting the comparison output to high. These comparison outputs are input to an FF circuit 201*e*-6 in the subsequent part, and is output as a pulse waveform (CLK_out in FIG. 4A). Then, when the count value reaches a predetermined count value, the PWM counter 201*e*-3 outputs a reset signal to update data in the latch circuit 201*e*-1, and also resets the comparators 201*e*-4 and 201*e*-5.

Next, a description will be given of a method of controlling constant speed of a drum shaft of the black drum 101K driven by the stepper motor.

In FIG. 3, the motor controller 202 (first control unit) is a control block which controls the speed of the stepper motor implementing the drive motor 102K for driving the black drum 101K.

In the speed control for the stepper motor, the speed control can be performed according to the frequency of the input pulse signal, and further, position control can be performed according to the number of pulses. Then, similarly to the case of the brushless DC motor indicated in the above-mentioned (a-1) to (a-5), the drive motor 102K is subjected to the speed control according to a procedure described hereinbelow by the motor controller 202. Note that since this control is performed when in the constant region 611, the control switching unit 202*g* in the motor controller 202 is configured to use a controller in dashed lines in FIG. 3.

(b-1) A signal output from the encoder sensor 105K (first speed-detecting unit) is input to a speed-detecting section 202*b*. The speed-detecting section 202*b* is configured to detect a speed from a period of a pulse signal from a pulse signal sequence from the encoder sensor 105K, or detect a speed from a count of the pulse signal of a pulse signal sequence at a predetermined sampling time period (differentiation of a position=speed).

(b-2) Computation for comparison with a speed command signal 202*a* sent from the control unit (not shown) which controls the overall operations of the image forming apparatus is carried out, and the computation result is input to a general PI (proportional integral) controller 202*c*, so as to execute error amplification based on a preset proportional gain and a preset integral gain. Note that the speed command signal 202*a* is a frequency value determined by the resolution of the encoder sensor 105K, or a count value at a predetermined sampling period.

(b-3) The result of (b-2) is further integrated by an integrator 202*d* whereby a positional deviation (time integration of speed=position) is taken into account.

(b-4) An oscillation controller 202*e* generates a pulse signal having a predetermined frequency, based on the value of (b-3).

(b-5) A motor drive circuit 202*f* controls the rotational speed of the drive motor 102K based on the pulse signal generated in (b-4).

Figure 4A:
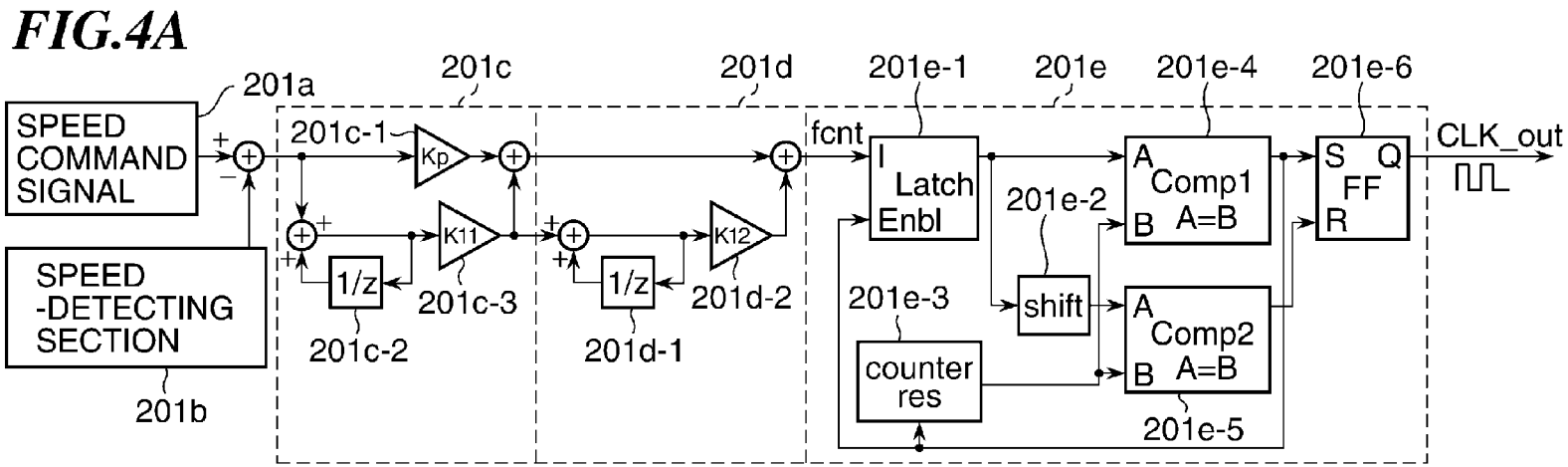
FIG. 4A is a diagram showing detailed circuit configuration of control blocks of a conventional motor controller.
Figure 4B:
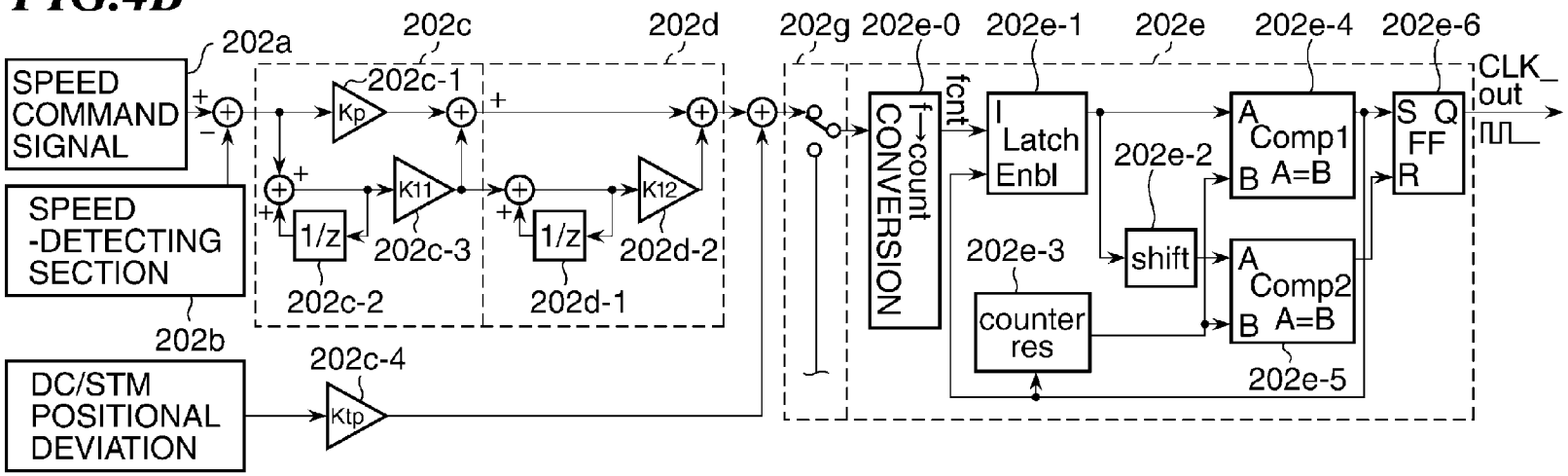
FIG. 4B is a diagram showing detailed circuit configuration of the control blocks, shown in FIG. 3, of the motor controller of the present embodiment.

FIG. 4A is a diagram showing detailed circuit configuration of the control blocks of the conventional motor controller 202, and FIG. 4B is a diagram showing detailed circuit configuration of the control blocks of the motor controller 202 appearing in FIG. 3 in the present embodiment.

The control blocks shown in FIG. 4B differ from the above-mentioned control blocks shown in FIG. 4A in that the PWM signal-generating section (PWM controller 201*e*) (see FIG. 3) is changed to a frequency modulated signal-generating section (oscillation controller 202*e*) (see FIG. 3).

Further, the control blocks shown in FIG. 4B differ from the control blocks shown in FIG. 4A in that a deviation between position information for the DC motor and position information for the stepper motor (deviation obtained by normalizing position information on the motors based on the number of encoder pulses by an ENC/ENC correction section 255, and subjecting the normalized position information to deviation computation) can be superimposed on the output from the integrator 202*d*.

The PI controller 202*c* is configured to output, based on the subtraction result of the speed deviation in the preceding stage, a value obtained by adding a proportional term (202*c*-1) multiplied by a proportional gain Kp to an integral term, multiplied by an integral gain Ki (202*c*-3), of a deviation obtained by a one sample delay element (1/z) (201*c*-2).

The integrator 202*d* performs an operation similar to that for calculation of the integral term of the PI controller 202*c*, and is configured to integrate an integral term output from the PI controller 202*c* again. Note that the PI controller 202*c* and the integrator 202*d* perform computation processing based on the speed detection signals from the speed-detecting section 201*b* read at a predetermined sampling period. Further, a proportional term multiplied by a proportional gain Ktp (202*c*-4) for taking into account the above-mentioned positional deviation between the motors is added to the output from the integrator 202*d*.

The oscillation controller 202*e* has almost the same configuration as that of the PWM controller 201*e*, except that the PWM controller 201*e* varies the pulse width at a fixed period, but the oscillation controller 202*e* varies the period.

Figure 7:
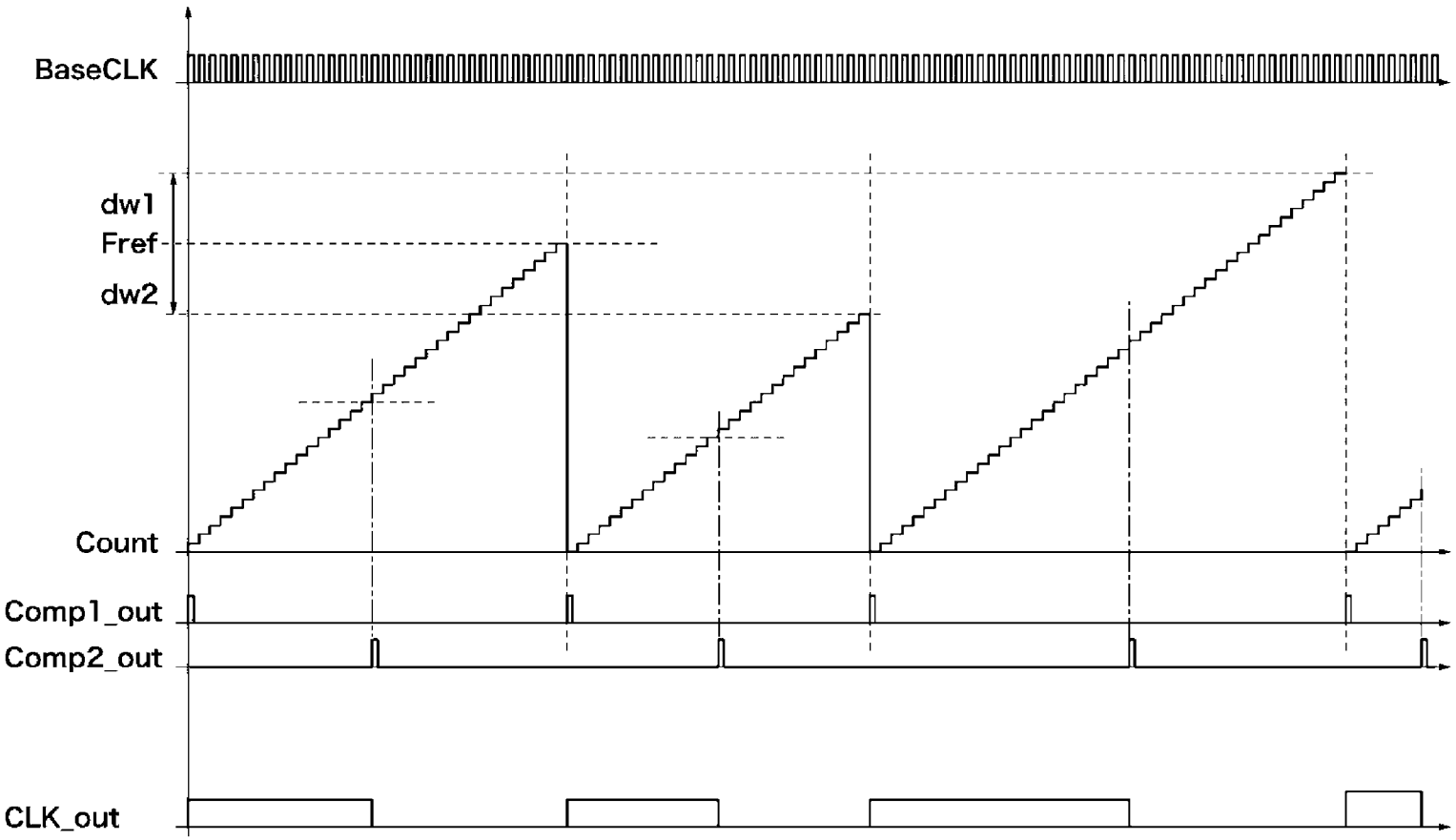
FIG. 7 is a diagram showing how the pulse period changes based on a speed deviation dω.

Further, as mentioned above, the oscillation controller 202*e* is required to change the counter value, i.e. a period manipulation value, based on the speed detection signals detected at the predetermined sampling period, i.e. the frequency manipulation values (Fref, dw1, and dw2 in FIG. 7) subjected to error amplification. However, the period is the inverse of the frequency, and hence a frequency-period conversion section 202*e*-0 is provided which performs processing for once converting a value from the controller in the preceding stage to an inverse thereof. The inverse calculation processing is performed based on the division algorithm by a well-known restoration method, and hence a description thereof is omitted. The period count value determined by the inverse calculation is once latched by a latch circuit 202*e*-1. Then, the latched value is used as period data in a comparator 202*e*-4, for comparison with a count value counted at a counter 202*e*-3. When the count value becomes equal to a preset value, a comparison output is set to high (Comp1_out in FIG. 7).

Then, the counter 2023-3 is reset, and data in the latch circuit 202*e* is updated. Similarly, a shift circuit 202*e*-2 sets ½ of the period data in a comparator 202*e*-5 as pulse width data. When the count values become equal to a preset value, a pulse width period is determined by setting the comparison output to high (Comp2_out in FIG. 7). These comparison outputs (Comp1_out and Comp2_out) are input to an FF circuit 202*e*-6 in the subsequent part, and are output as a pulse waveform (CLK_out in FIG. 4B).

As described above, by using the stepper motor for the drive motor 102K for driving the black drum 101K, it is possible to use the same model of the speed reducer 104 as that for the color drums 101.

Next, a description will be given of speed following control executed when the motors are started (start-up region 610) and stopped.

FIG. 5 is a diagram useful in explaining operations of a stepper motor and a brushless DC motor when the speed of the stepper motor is caused to follow up changes in the speed of the brushless DC motor at the start-up of the motors.

In the present embodiment, it is assumed that the speed of the stepper motor is controlled to follow up changes in the speed of the DC motor Y. The following signals associated with the control on the DC motor side are signals associated with the DC motors Y. Note that the DC motor Y, and the DC motors M and C have similar characteristics, and hence it is possible to control the DC motor Y, and the DC motors M and C to similar speeds by executing the control based on the same speed command.

Referring to FIG. 3, an output signal from the speed-detecting section 201*b* is sent to an acceleration-detecting section 251. The acceleration-detecting section 251 calculates acceleration based on a change in the load shaft rotational speed at predetermined time intervals. The calculated acceleration is limited within a maximum acceleration rate by a change rate-limiting section 252 so as to prevent the stepper motor from losing synchronization. The output signal limited within the maximum acceleration rate by the change rate-limiting section 252 is input to the control-switching unit 202*g* of the motor controller 202 so as to follow up changes in the starting speed on the brushless DC motor side. Then, the signal is used as a speed command signal CLK_st (first signal) to the stepper motor when starting and decelerating the same.

Further, the output from the integrator 201*d* for generating the PWM signal for the DC motor driving circuit is also input to an exciting current-correcting section 258 for correcting a current control value of the stepper motor.

At the start-up of the motors (the start-up region 610 in FIG. 5), when the speed detection value detected by the speed-detecting section 201*b* of the motor controller 201 reaches a predetermined speed, the control switching unit 202*g* of the motor controller 202 (speed command signal-switching unit) performs control for switching the control to normal control again (the constant region 611 in FIG. 5). Specifically, the acceleration-detecting section 251 reads the detection results from the speed-detecting section 201*b* at a predetermined period to carry out acceleration computation. Based on the computation result, limitation is set by the acceleration rate so as to prevent the stepper motor from suffering loss of synchronism, whereby the start-up control is executed. That is, the speed command signal at the start-up of the motors is set to a speed command signal (CLK_st) at the start-up of the motors, which is generated by the speed-detecting section 201*b*, the acceleration-detecting section 251 which performs acceleration computation based on the detection result from the speed-detecting section 201*b*, and the change rate-limiting section 252 for making the computation output not larger than a predetermined value. Then, the speed command in the normal time is set to a speed command generated by the motor controller 202 (first control unit) which controls the encoder sensor 105K to a predetermined speed.

Here, the speed detection is, as shown in 601 in FIG. 5, performed by period measurement of a pulse interval detected by the encoder wheel and sensor, using a counter. However, in view of a case where a delay is generated (first region indicated by a dashed line in 601 in FIG. 5) until the pulse is detected by the position of the encoder wheel because the rotational speed immediately after the start-up time is low, the self-start frequency and the initial acceleration on the stepper motor side are set in advance.

The used speed region for the stepper motor side is in a lower speed region than that for the DC motor, and hence when the stepper motor is driven by general full-step driving, one pulse interval at the start-up time becomes longer, and as a result, the difference in speed between the motors sometimes increases (604 in FIG. 5). Therefore, the stepper motor is driven by 4-division micro step driving (605 in FIG. 5).

As shown in 602 in FIG. 5, the result obtained by the acceleration computation performed by the acceleration-detecting section 251 based on the speed detected by the speed-detecting section 201*b* (actual rotational speed) is subjected to acceleration limitation so as to prevent the result from becoming larger than the maximum acceleration rate set by the change rate-limiting section 252 in advance. A value obtained by adding up the result and the initial speed set value is input to the oscillation controller 202*e* (speed command generation unit), as a speed command signal CLK_st to the stepper motor, via the control switching unit 202*g*. Then, the start-up control for the stepper motor is executed in a manner following up changes in the acceleration of the DC motor side (acceleration changes shown in 603 in FIG. 5).

On the other hand, when decelerating the motors, as shown in FIG. 3, in the motor controller 202, a positional deviation indicated by the difference of counts between a position counter STM 254 and a position counter DC 253 is added to the output from the integrator 202*d*. That is, the relative positional deviation between the photosensitive drum driven by the DC motor and photosensitive drum driven by the stepper motor becomes larger as a control variable on the DC motor side varies in a decelerating direction. This reduces an input value CLK_cmp (second signal) to the oscillation controller 202*e*, and the stepper motor side follows this, which makes it possible to decelerate the stepper motor. As a result, it is possible to reduce the difference in speed between the motors when the motors are started and decelerated, whereby it is possible to reduce friction caused by the peripheral speed difference between the photosensitive drums, and between the associated drum and the intermediate transfer belt.

As described above, by correcting the amount of the exciting current supplied to the stepper motor according to the control variable (pwm_cmp) on the DC motor side and the amount of position displacement of the photosensitive drum to be driven by the position command, it is also possible to reduce the position displacement caused by a change in torque. Further, by mutually using control information on the respective drive sources, the speed difference at the start-up and deceleration of the motors is reduced, whereby it is also possible to reduce generation of scratches on the surfaces of the photosensitive drums.

Further, as mentioned above, the outer diameter of the photosensitive drum 101K to be driven is larger than that of the other photosensitive drums, the moment of inertia ratio including the flywheel 106K is proportional to the square of the outer diameter, and the ratio of torque applied to the motor shaft side is also proportional to the outer diameter ratio. Therefore, it is possible to obtain an effect that transmission of vibration generated in the motor to the photosensitive drum side is reduced by the low-pass filter effect obtained by the moment of inertia and the frictional resistance. That is, when using the stepper motor as the drive source, the stepper motor can be applied to an arrangement that can easily eliminate a high frequency vibration factor caused by the stepping operation of the motor itself.

Further, since the photosensitive drum 101K has the large outer diameter, it is possible to prolong the service life of the photosensitive drum 101K, which makes it possible to reduce running costs, and improve performance of maintenance.

Next, a description will be given of a method of reducing positional deviation of the rotor due to changes in torque of the stepper motor.

First, a behavior of the stepper motor when the load torque is applied to the stepper motor will be described with reference to FIGS. 6A and 6B.

Figure 6A:
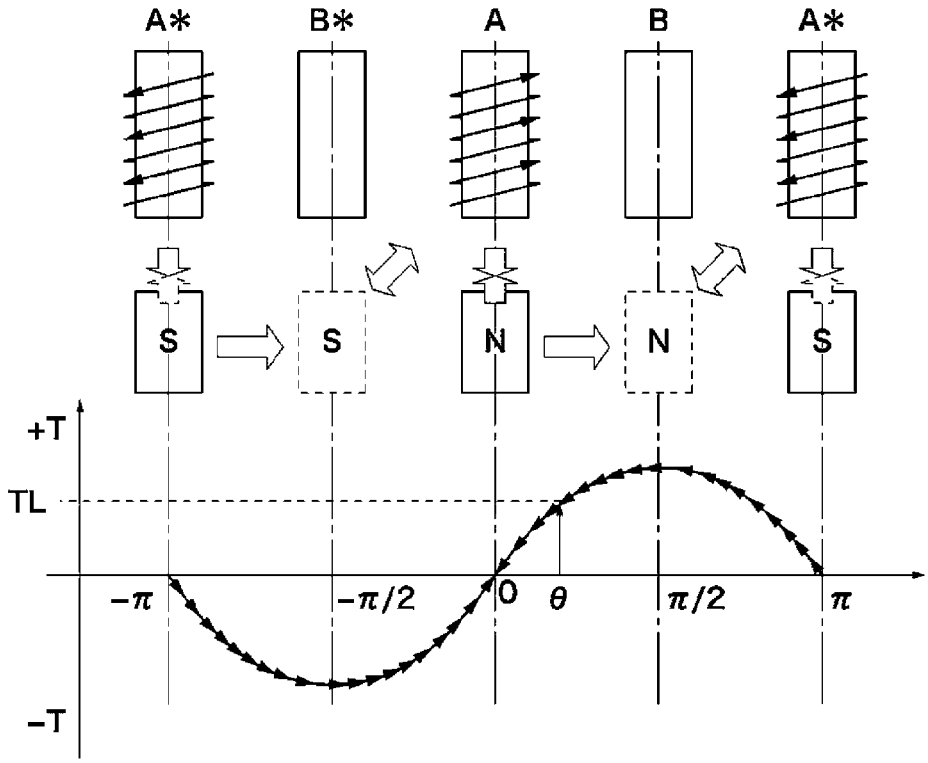
FIG. 6A is a diagram showing respective states of a rotor and a torque T, which is useful in explaining changes in a balance position when a predetermined electric current is supplied to a motor coil of the stepper motor, and a load torque TL is applied to an output shaft as an outer force.
Figure 6B:
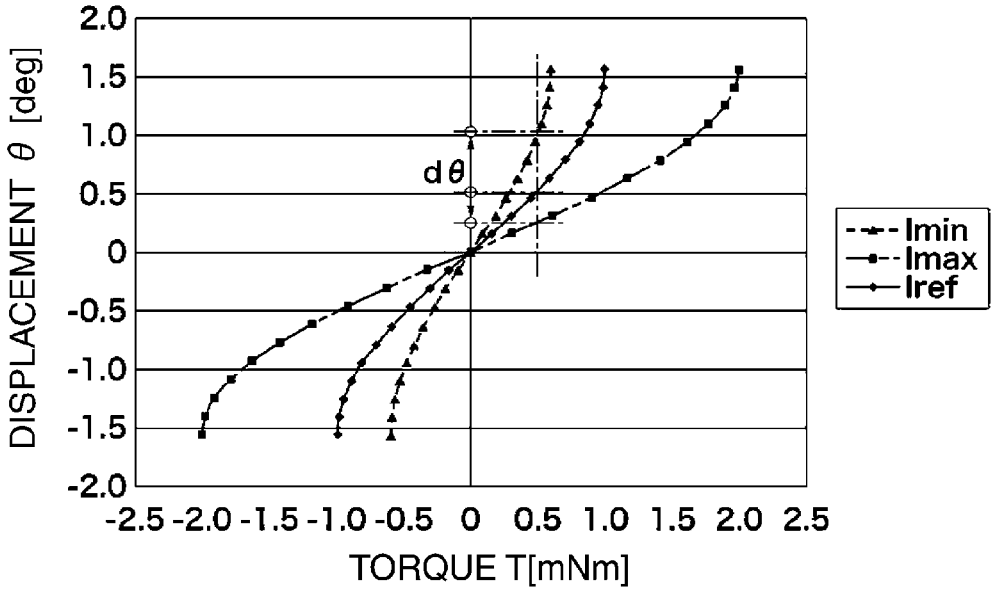
FIG. 6B is a diagram showing respective states of the torque T and a displacement θ, which is useful in explaining changes in the balance position.

FIGS. 6A and 6B are diagrams showing how a balance position changes when a predetermined electric current is supplied to a motor coil of the stepper motor and a load torque TL is applied to an output shaft as an outer force.

The upper part in FIG. 6A shows how magnetic flux and the rotor-side magnetic poles generated when an exciting current is supplied to a stator coil of the stepper motor attract and repel. Then, when the load torque TL is equal to 0, the stator coil magnetic flux and the rotor-side magnetic poles are balanced at a stabilization point "θ=0" where a "deviation" is not generated therebetween. On the other hand, when the load torque TL is increased, a "deviation" is generated between the stator coil magnetic flux and the rotor-side magnetic poles. As a result, an attraction/repel torque is generated between the stator and the rotor, and the stator and the rotor are balanced at a balanced position "θ=θL" matching the load torque. Thus, the stepper motor has characteristics that the balanced position changes according to the load torque, and when the balanced position is displaced by an angle not smaller than a predetermined displacement angle, the stepper motor is in a state of what is called "loss of synchronism" in dynamic characteristics, in which the synchronism is lost, making it impossible to rotate the stepper motor. That is, the stepper motor has a problem that although the speed control by an open loop control can be performed according to the frequency of the input pulse signal, the stepper motor operates with the positional relationship of the rotor varying due to changes in the load torque.

To solve the above problem, as shown in FIG. 6B, by varying the exciting current supplied to the stator coil of the motor, it is possible to control changes in the balanced position within a certain range. The illustrated example shows that if a two-phase stepper motor which rotates through an angle of 1.8 degrees per one step is driven by a general constant current control method, and a load torque of 0.5 mN·m is applied, it is possible to obtain a change in the displacement amount θ (d∂ in FIG. 6B) when the constant current control variable is changed from Imin to Imax. From the above, it is possible to relatively reduce the position displacement of the rotor caused by changes in torque of the stepper motor, by setting the exciting current to be used as a reference according to the load fluctuation range of the system in which the stepper motor is mounted, and changing the amount of exciting current according to the load. The displacement amount is reduced by using this characteristic in a following manner:

Referring to FIG. 3, the position counter DC 253 is a position-detecting unit (second position-detecting unit) which is connected to the encoder sensor 105Y, and is used for detecting the position of the rotational shaft of the drive motor 101Y by counting the slits of the encoder wheel 103Y.

The position counter STM 254 is a position-detecting unit (first position-detecting unit) which is connected to the encoder sensor 105K, and is used for detecting the position of the rotational shaft of the drive motor 101K as the stepper motor by counting the slits of the encoder wheel 103K.

The ENC/ENC correction section 255 is a preprocessing part which corrects an encoder count value based on the outer shape ratio of the color drums and the black drum, and performs deviation computation between the corrected output from the position counter STM 254 and the output from the position counter DC 253. This is for detecting a relative displacement (deviation) in the rotational phase between the black drum and the color drums, and the detected deviation is output to the motor controller 202.

An ENC/CLK correction section 256 corrects a resolution ratio of the encoder wheel 103K of the black drum to a unit drive pulse as a position command to the stepper motor 102K which drives the black drum. For example, when the stepper motor 102K which rotates once for each 200 pulses (step angle=1.8 degrees) rotates by one step, if a gear ratio is 1:9 and the encoder of the black drum has the resolution of 14400 pulses/rotation, CLK:ENC=1:8 is obtained. A value obtained by computation of the deviation between the detection correction value of the position of the black drum, output from the corrected position counter STM 254, and the output from a pulse counter 257 which counts the number of pulses from the oscillation controller 202*e* which generates the speed command signal to the stepper motor 102K is output to the exciting current-correcting section 258.

The exciting current-correcting section 258 performs correction gain calculation of a value of the exciting current supplied to the motor drive circuit 202*f*, so as to add a value obtained by multiplying the value of pwm_cmp by a predetermined gain, which is output from the integrator 201*d* which determines the PWM modulation degree based on the fluctuation in speed on the DC motor side, to the positional deviation value. The determined current correction gain is a reference value Iref used in the motor drive circuit, a minimum value Imin which ensures a predetermined margin with respect to the load torque, and a maximum value Imax set to the allowable current value at a driver IC. Then, the current correction gain is set such that it is possible to correct the exciting current within the range shown in FIG. 6B. Specifically, a value based on assumption of load torque in the initial state of the apparatus is set as the reference value Imin (e.g. 0.8 A), and the maximum value Imax is set to the driver IC based on the rating (e.g. 1.5 A). Here, in a state where influences of the other component elements are eliminated during the actual initializing operation of the apparatus, the reference value Iref is set by the position counter DC 253, so as to monitor and record changes in speed condition per one rotation of the drum or per one rotation of the intermediate transfer member.

Note that in the rotational speed control of the photosensitive drum shaft on the brushless DC motor side, the rotational speed is controlled to be constant by eliminating factors for fluctuations in speed including the transmission system. Therefore, it is not possible to detect only changes in torque only by the PWM signal simply controlled based on the output value from the integrator 201*d* of each of the motor controller 201Y, 201M, and 201C. However, to correct the exciting current supplied to the stepper motor, and reduce position displacement due to changes in torque, the PWM control variable including an amount corresponding to the fluctuation in speed not depending on the torque change of the brushless DC motor side may be detected. Note that in the present embodiment, the position counter DC 253 can also detect the PWM control variable (i.e. output from the integrator 201*d*) and the relative rotational position of the photosensitive drum. Then, it is possible to manage the history of outputs from the integrator 201*d* in association with changes in speed during each rotation of the drum, whereby it is possible to extract only changes in the load torque during operation.

Further, in fact, torque changes are also caused by the difference in the peripheral speed between the photosensitive drums (101K, 101Y, 101M, and 101C) and the intermediate transfer belt 111. In the present embodiment, the shaft speed of the drive roller of the intermediate transfer belt appearing in FIG. 2 is detected by the encoder sensor 105T, and the speed control for the DC motor 102T is performed by a motor controller 201T based on the detection result. The exciting current-correcting section 258 may correct the exciting current amount by taking an amount of deviation in speed between the drum shaft speed and the belt shaft speed into account. With this operation, the load torque applied to the photosensitive drum is estimated, and increasing and decreasing correction is performed with respect to the reference value of the exciting current supplied to the stepper motor, which eliminates the need of setting the exciting current to be larger than necessary, which makes it possible to reduce power consumption, and reduce position displacement of the rotor.

Further, although in the above-described embodiment, the speed of the stepper motor side is controlled to follow up changes in speed of the DC motor 102Y, the speed of the stepper motor side may be controlled to follow up changes in speed of the DC motors 102M and 102C as the other DC motors. Further, the speed of the stepper motor side may be controlled to follow up the changes in speed of the DC motor 102T for driving the intermediate transfer belt. The motor controller 201T has the same configuration as that of the motor controllers 201Y, 201M, and 201C. Therefore, in this case, the output from the encoder sensor 105T is input to the position counter DC 253, and the output from the integrator 201*d* of the motor controller 201T is input to the exciting current-correcting section 258.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-151990, filed Jul. 2, 2010, which is hereby incorporated by reference herein in its entirety.

What is claimed is:

1. An image forming apparatus comprising:

a first image forming unit configured to form a toner image on a first photosensitive member;

a DC motor configured to drive the first photosensitive member for rotation;

a detection unit configured to detect information on a rotational speed of the first photosensitive member;

a second image forming unit configured to form a toner image on a second photosensitive member;

a stepper motor configured to drive the second photosensitive member for rotation;

a transfer unit configured to transfer toner images formed on the first and second photosensitive members to a sheet;

a first control unit configured to generate a control value of the DC motor based on the detected information on the rotational speed of the first photosensitive member and a first speed command; and a second control unit configured to control a drive frequency of the stepper motor based on information on the rotational speed of the first photosensitive member.

2. The image forming apparatus according to claim 1, wherein the second control unit controls exciting current supplied to the stepper motor based on the generated control value of the DC motor.

3. The image forming apparatus according to claim 2, further comprising:

a drive unit configured to drive the transfer unit, and wherein the second control unit controls the exciting current supplied to the stepper motor based on the detected information on the rotational speed of the first photosensitive member and information on a rotational speed of the drive unit.

4. The image forming apparatus according to claim 1, wherein:

the second control unit has a first mode and a second mode, the second control unit controls, in the first control mode, the drive frequency of the stepper motor based on the detected information on the rotational speed of the first photosensitive member, the second control unit controls, in the second control mode, the drive frequency of the stepper motor based on a second speed command and a deviation in the rotational phase between the first and second photosensitive members, and wherein the second control unit controls the drive frequency of the stepper motor with the first control mode at startup processes of the DC motor and the stepper motor.

5. The image forming apparatus according to claim 4, further comprising:

a second detection unit configured to detect information on a rotational speed of the second photosensitive member, wherein the first control unit performs feedback control based on the detected information on the rotational speed of the first photosensitive member, and wherein the second control unit performs, in the second control mode, feedback control based on the detected information on the rotational speed of the second photosensitive member.

6. The image forming apparatus according to claim 1, wherein:

the first image forming unit forms a color toner image, the second image forming unit forms a black toner image, and the second photosensitive member has an outer diameter larger than that of the first photosensitive member.

* * * * *